United States Patent [19]

Lancelot et al.

[11] Patent Number: 5,073,428

[45] Date of Patent: Dec. 17, 1991

[54] FOLDABLE PLASTIC PRODUCT

[75] Inventors: Charles J. Lancelot, Winchester; Anthony F. Shaw, Bluemont; Edward O. Tate, Jr., Berryville, all of Va.

[73] Assignee: Rubbermaid Incorporated, Wooster, Ohio

[21] Appl. No.: 418,605

[22] Filed: Oct. 10, 1989

[51] Int. Cl.[5] ..... B32B 3/10; B32B 3/08

[52] U.S. Cl. ..... 428/67; 428/213; 428/217; 428/61; 428/120

[58] Field of Search ..... 428/58, 61, 67, 213, 428/217; 156/298, 304.3

[56] References Cited

U.S. PATENT DOCUMENTS

| | | | |
|---|---|---|---|
| 3,292,513 | 12/1966 | Palmer . | |
| 3,330,001 | 7/1967 | Paul et al. . | |
| 3,447,199 | 6/1969 | Trimble . | |
| 3,574,306 | 4/1971 | Alden . | |
| 3,793,612 | 2/1974 | Driscoll . | |
| 4,002,417 | 1/1977 | Vecchistti et al. . | |
| 4,094,217 | 6/1978 | Exline . | |
| 4,179,252 | 12/1979 | Seifert . | |
| 4,387,128 | 6/1983 | Emms et al. | 428/60 |
| 4,448,625 | 5/1984 | Carrera . | |
| 4,457,199 | 7/1984 | Corcoran . | |
| 4,463,046 | 7/1984 | Hutchison et al. | 428/217 |
| 4,476,174 | 10/1984 | Carrera | 428/58 |
| 4,528,706 | 7/1985 | Branker . | |
| 4,784,888 | 11/1988 | Schwertner et al. . | |

FOREIGN PATENT DOCUMENTS

| | | |
|---|---|---|
| 1403913 | 5/1963 | France . |
| 708025 | 11/1963 | Italy . |
| 52-31269 | 3/1977 | Japan . |
| 439076 | 12/1967 | Switzerland . |
| 1063697 | 3/1967 | United Kingdom . |

*Primary Examiner*—Alexander S. Thomas

*Attorney, Agent, or Firm*—Renner, Kenner, Greive, Bobak, Taylor & Weber

[57] ABSTRACT

A foldable plastic product, such as a floor mat (10), comprises a sheet of material including at least two panels (16, 17) having upper surfaces (11), lower surfaces (12) and sides (13) spanning the upper and lower surfaces and defining the thickness of the sheet. At least one bridge portion (18) is provided, the upper surface of which integrally connects the upper surfaces (11) of the panels (16, 17). The thickness (D) of the bridge portion (18) is less than the thickness of the sheet. At least one hinge portion (20) is provided having an upper surface (22) coincident with the bridge portion (18). The lower surface (21) of the hinge portion (20) integrally connects the lower surfaces (12) of the panels (16, 17). The hinge portion (20) is preferably formed of a material selected from the group of thermoplastic elastomers selected from the group consisting of thermoplastic polyurethanes and plasticized polyvinylchlorides having a Shore A hardness of between about 65 to about 80 durometer.

14 Claims, 2 Drawing Sheets

FOLDABLE PLASTIC PRODUCT

TECHNICAL FIELD

This invention relates to a plastic product that is capable of being folded and to the process of making such a product. More particularly this invention relates to a plastic product, such as a floor mat or a chair mat, that can be folded upon itself through an arc of approximately 180° and yet be returned to its flat condition of normal use.

BACKGROUND ART

An elongated mat of plastic material is a well known product for use in homes and certain commercial applications as a protective overlay for carpeting. Generally such mats are used in association with chairs to not only protect the carpet against concentrated wear associated with movement of the chair, but also to facilitate ease of movement of the chair across the floor surface inasmuch as the chair is permitted to move across the mat as opposed to the carpet.

These mats are commonly used in commercial application in conjuction with office services. Due to the length of the desks with which such mats are used, the mats often are required to be of a length which makes storage, shipping, and retail display in their fully elongated configuration impractical, difficult and costly. Over the years attempts have been made at improving such floor mats, with the purpose of eliminating their impracticability as the primary focus. That is, efforts have been made to develop plastic products that possess easy, durable and repeatable folding characteristics which can be made by simple and economical processes. These prior efforts, however, have failed to achieve this goal so that there remains a longfelt need in the market for such a product and an economical and simple method for making the same.

Examples of such prior attempts include the device depicted in U.S. Pat. Nos. 4,448,625 and 4,476,174. These patents disclose a method of making a composite plastic product having an integrally laminated plastic strip extending transversely across the under surface of the mat and a slit extending through its upper surface downwardly to the plastic strip which facilitates folding of the mat. Such a solution, however, is undesirable because the slit extending through the upper surface of the mat can be construed by the user to be a defect, is unsightly, serves as a collection source for dirt and other minuscule particles thereby accentuating the unsightly nature thereof, and results in eventual failure of the mat. For example, since the slit is in the upper surface of the mat, the movement of the rollers of a chair over the slit causes repeated flexing of the joining plastic strip which will ultimately crack or otherwise fail. Moreover, the user is likely to be aware of the slit as his chair moves thereover.

Another example of a prior attempt is the foldable plastic product depicted in U.S. Pat. No. 4,784,888. The product of that patent, preferably a chair mat, includes an elongate hinge extending in at least one of the length and/or width directions of the product between the product's sides. The hinge is created by the formation of an angled or curved slit configuration from the underside of the plastic product which is preferably in an L-shaped configuration. This solution is also undesirable because the L-shaped slit often leads to irregularities in the upper mat surface after repeated folding.

Moreover, as with the mat of the other prior art, repeated movement of the chair rollers over the slit causes repeated flexing about the slit and ultimate cracking or other failure at the slit.

In an effort to eliminate these problems, attempts have been made to produce a mat having a middle section made of a thinner material or of a more flexible material than the remaining portion of the mat. However, as yet, such mats have not been able to be produced to exhibit a uniformly hard surface, that is, one which does not yield to the forces placed upon the upper surface of the mat in the course of its normal use in the portion of the mat containing this different material. The most common problem experienced in the mats of this type is that the portion of the mat containing the different material yields and thereby results in the mat having a dip or uneven surface in that portion when a chair is rolled thereacross. Thereafter, such mats are unsuitable for their normal and intended use, that is, enabling a chair to roll across the upper surface without encountering changes in elevation. Moreover, the middle section of the more flexible softer material often will collect dirt rendering the mat unsightly.

DISCLOSURE OF THE INVENTION

It is therefore a primary object of the present invention to provide a foldable plastic product, such as a floor mat or chair mat that is capable of being folded upon itself approximately 180°.

It is another object of the present invention to provide a foldable plastic product, as above, in which such foldability is imparted to the product by virtue of an integrally formed living hinge.

It is a further object of the present invention to provide a foldable plastic product, as above, in which the hinge thereof is easily formed by simple processing techniques.

It is yet another object of the present invention to provide a foldable plastic product, as above, which does not require or include a slit or any like interruption to impart foldability to the product.

It is a still further object of the present invention to provide a foldable plastic product, as above, possessing durable and repeatable folding characteristics.

These and other objects of the present invention which will become apparent from the description to follow, are accomplished by the means hereinafter described and claimed.

In general, a foldable plastic product, such as a floor mat includes a sheet of material including at least two panels having upper surfaces, lower surfaces and sides spanning the upper and lower surfaces and defining the thickness of the sheet. At least one bridge portion is provided, the upper surface of which integrally connects the upper surfaces of the panels. The thickness of the bridge portion is less than the thickness of the sheet. At least one hinge portion is provided having an upper surface coincident with the lower surface of the bridge portion. The lower surface of the hinge portion integrally connects the lower surfaces of the panels. The hinge portion is preferably formed of materials selected from the group consisting of thermoplastic polyurethanes, thermoplastic polyesters, natural and synthetic rubbers and plasticized polyvinylchlorides having a Shore A hardness of between about 55 to about 85 durometer.

PREFERRED EMBODIMENT FOR CARRYING OUT THE INVENTION

Figure 1:
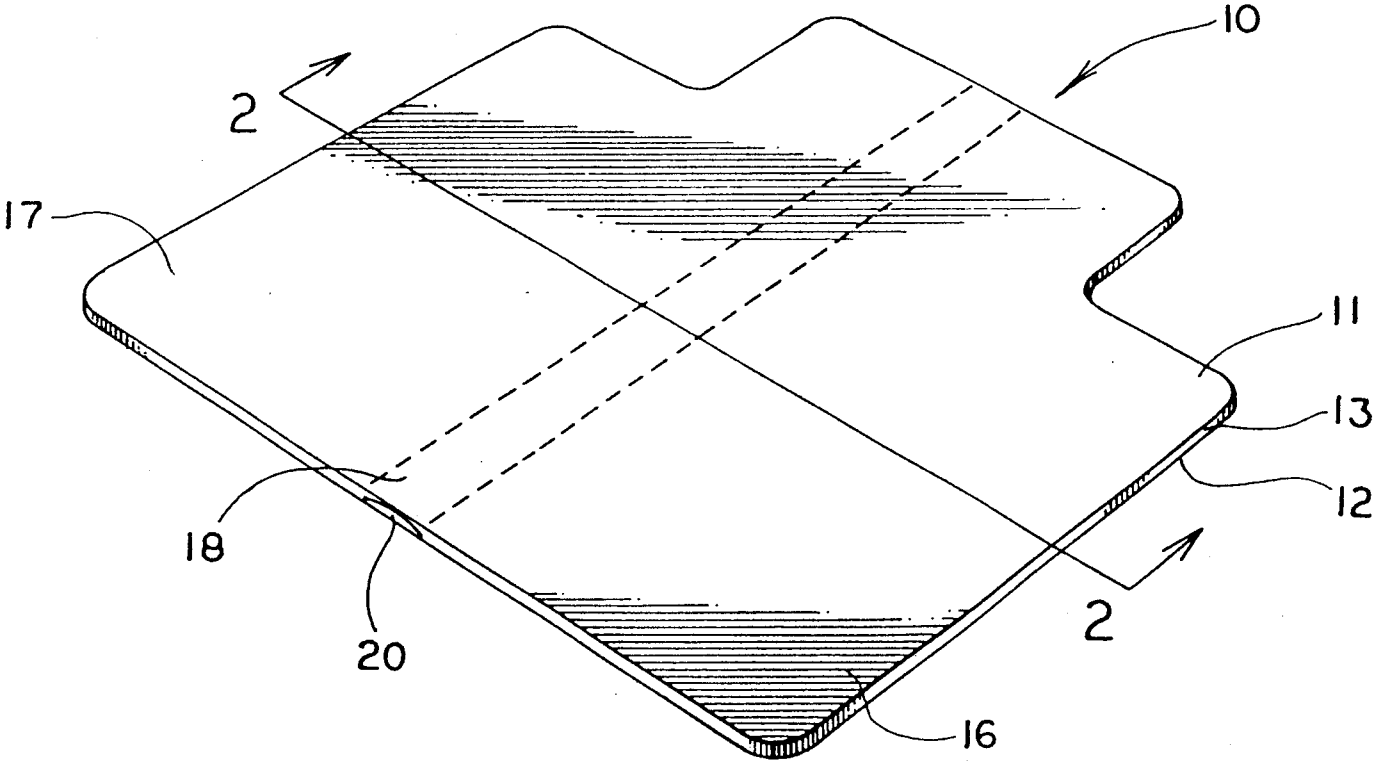
FIG. 1 is a perspective view of a foldable plastic product of the present invention shown in the rather conventional configuration of a chair mat.

A flexible plastic product accoring to the concept of the present invention is indicated generally by the numeral 10 and is shown as a sheet of material in the conventional configuration of a chair mat, however, it should be appreciated that all suitable configurations for any type of floor mat or like flexible plastic products are clearly within the spirit of the present invention. Chair mat 10 has an upper surface 11, a lower surface 12, and sides or edges 13 extending therebetween. Edges 13 define the thickness of mat 10 which typically ranges from about 0.100 inches to about 0.200 inches.

As depicted in FIG. 1, upper surface 11 is generally planar, however, it may carry a decorative embossing or other surface configuration as are well known to those skilled in the art. Moreover, as is conventional, mat 10 may include a ramped or sloped surface (not shown) extending about its peripheral edge so that, for example, the rollers of a chair supported by mat 10 can more easily roll from the floor upon which the mat rests onto upper surface 11 of mat 10. Additionally, mat 10 may be provided with protrusions or cleats 15 projecting downwardly from lower surface 12 which serve as grippers to engage an underlying carpet or other flooring material upon which mat 10 is placed. It should be appreciated that the presence of the sloped surface, the upper planar surface, and the protrusions 15 carried by lower surface 12 are not essential to the present invention with other designs or configurations clearly being within the scope of the present invention.

Figure 2:
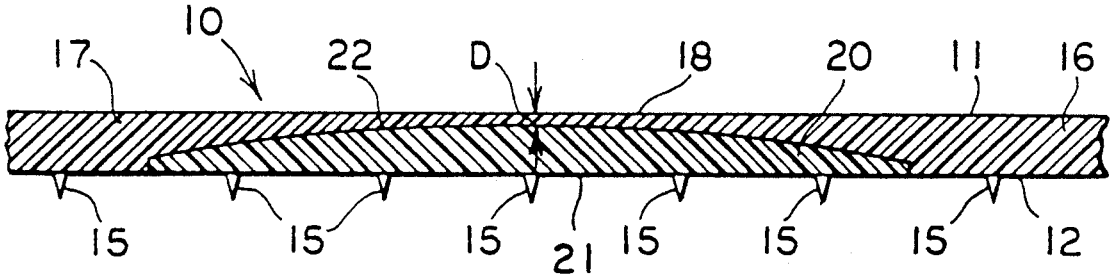
FIG. 2 is a fragmented sectional view of a foldable plastic product of the present invention taken along the line 2—2 of FIG. 1.

With reference generally to FIGS. 1 and 2, upper surface 11 is shown as including panels 16 and 17 and a bridge 18 spanning the area between panels 16 and 17. Similarly, lower surface 12 includes the under surface of panels 16 and 17 integrally connected by a hinge 20. As depicted, hinge 20 and corresponding bridge 18 extend transversely across the lower and upper surfaces, respectively, of mat 10, defining panels 16 and 17 on each side thereof.

It should be appreciated that bridge 18 and hinge 20 do not have to be visually distinguishable from panels 16 and 17, and that the distinctions shown in the drawings are merely for illustrative purposes. Preferably, hinge 20, although of a different material as will be explained more fully hereinbelow, is preferably of the same clarity and texture as the remaining portions of mat 10, if mat 10 is constructed of a clear material. However, if mat 10 is constructed of an opaque material, hinge 20 does not necessarily have to be of the same color and texture.

While only one hinge 20 is depicted, thereby enabling the upper surfaces of panels 16 and 17 to be folded into a juxtaposed relationship for purposes of storage, display, handling, or shipping, additional hinges may be provided. For example, instead of the one hinge construction shown in the drawings two or more hinges may be utilized to enable mat 10 to be folded about itself several times or in alternative directions.

As depicted in FIGS. 1 and 2, hinge 20 preferably is of a cycloid configuration wherein the base portion 21 of hinge 20 is coincident with the lower surface 12 of mat 10, that is, the lower surfaces of panels 16 and 17. Arcuate surface 22 of hinge 20 extends into the thickness of mat 10 and is coincident with the lower surface of bridge 18. Particularly bridge 18 extends a depth D from the upper surface 11 of mat 10 into the thickness of the mat. Dimension D can vary depending upon a number of factors including, among others, the particular plastic materials that are selected as well as the thickness of mat 10. For a mat 10 of thickness 0.145 to 0.160 inches, dimension D can be from about 0.040 to about 0.070 inches. Accordingly, the height of hinge 20 for a mat 10 having a thickness of 0.145 to 0.160 inches can vary between from about 0.080 to 0.120 inches, and preferably between about 0.090 to 0.110.

It has been found that foldability and performance of mat 10 are dependent on the magnitude of dimension D. When the magnitude of dimension D exceeds 0.070 inches for a mat 10 having a thickness of 0.145 to 0.160 inches, foldability of mat 10 is impeded and becomes more difficult. On the other hand, when the magnitude of dimension D is less than 0.040, the bridge is likely to yield to loads placed on upper surface 11 of mat 10, such as the load created by a chair moving across mat 10. In such situations the mat loses its uniformity and a dip or groove is formed in upper surface 11 thereof.

Figure 3:
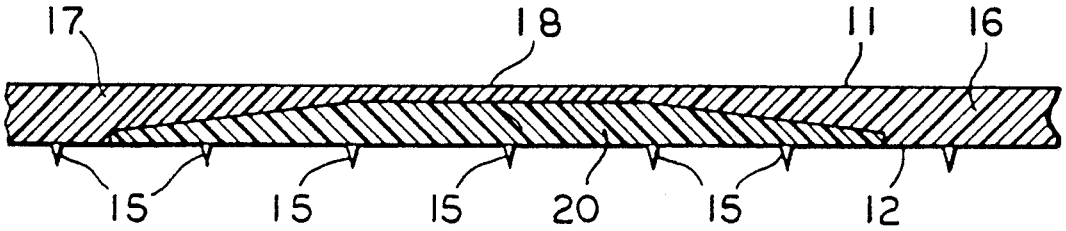
FIG. 3 is a somewhat schematic fragmented sectional view similar to FIG. 2 but showing an alternative hinge configuration which may be utilized in the foldable plastic product of the present invention.

Hinge 20 may also be of a trapezoidal shape, as illustrated in FIG. 3, or any other configuration suitable to impart the requisite foldability and durability characteristics. As will be discussed more fully hereinbelow, the precise configuration of hinge 20 is partially dependent upon the manner in which hinge 20 is formed, i.e., by coextrusion or by lamination.

Preferably panels 16, 17 and bridge 18 are formed of any suitable clear or opaque plastic materials well known to those skilled in the art of making rigid, semi-rigid or flexible plastic products. One such material which is preferred is a semi-rigid polyvinylchloride (PVC). Particularly preferred are PVC's having a durometer as measured on the Shore D scale ranging from between about 50 to about 75, and more preferably about 60 to about 70 durometer.

Hinge 20 can be formed of an elastomer selected from, but not limited to, the group consisting of thermoplastic polyurethanes, thermoplastic polyesters, natural and synthetic rubbers and plasticized polyvinylchlorides having a Shore A hardness of between about 55 to about 85 durometer. More preferably, such materials have a Shore A hardness of between about 65 to about 75 durometer. Particularly preferred are compounds having a Shore A hardness of 70+/−3 durometer.

Such compounds have excellent adhesive compatibility with the materials used to form panels 16, 17 and bridge 18. Moreover, such compounds have been identified as being suitable to provide repeatable and durable foldability to mat 10 without the presence of any slit in the upper surface 11 or lower surface 12 of mat 10.

A particularly preferable thermoplastic polyurethane is the commercially available series of thermoplastic compounds offered by B.F. Goodrich Company under the trade name ESTANE, which are ether type thermoplastic polyurethanes preferably having a Shore A hardness of 70 durometer.

One particularly preferable form of plasticized polyvinylchloride is one having a medium density dispersion resin and dioctyl phthalate (DOP) as a plasticizer and having a Shore A hardness of between about 55 and about 85 durometer. Other plasticizers which may be utilized include heptyl undecyl phthalate and diheptyl nonyl phthalate.

A typical thermoplastic polyester is the commercially available series of thermoplastic compounds offered by Dupont under the trade name HYTREL having a Shore A hardness of 55 to 63 durometer.

A typical synthetic rubber is the commercially available series of thermoplastic rubbers offered by Shell Oil Company under the trade name KRATON having a Shore A hardness of 55 to 85 durometer. Another synthetic rubber which could be utilized is the commercially available series of thermoplastic rubbers offered by Dupont under the trade name ELVALOY which are copolymers of ethylene and vinyl acetate having a Shore A hardness of 55 to 85 durometer.

Figure 4:
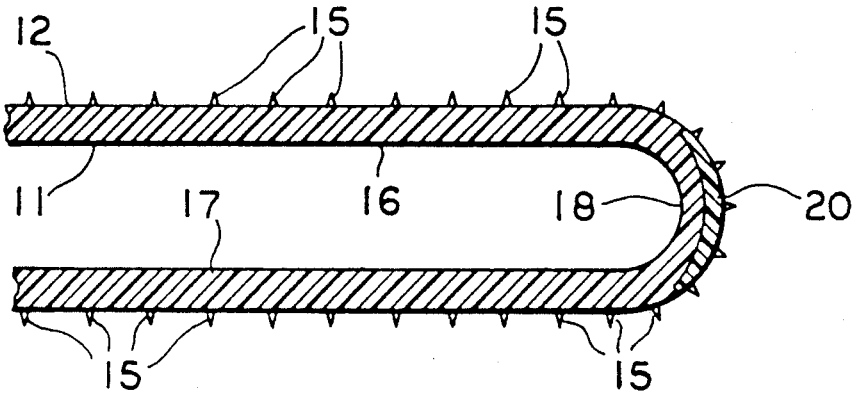
FIG. 4 is a somewhat schematic fragmented view of the foldable plastic product of the present invention as shown in FIG. 1 illustrating the manner in which the product is folded.

To fold mat 10, the upper surface of panel 16 is juxtaposed with the upper surface of panel 17 as is illustrated in FIG. 4. Cleats or protrusions 15, carried by lower surface 12 of mat 10, then protrude outwardly when mat 10 is in its folded position. However, if desired, mat 10 can be just as readily folded so that cleats 15 extend inwardly. As illustrated, chair mat 10 is thus folded substantially upon itself about an arc of 180°, thereby being about one-half its original size facilitating storage, retail display, handling and/or shipping.

Mat 10, as described above, may be formed by any conventional plastic forming process, such as extrusion, coextrusion or other methods of thermoforming. The sheet so formed may be then shaped by conventional cutting or molding equipment, and the resultant product folded about hinge 20, or hinges formed therein, and appropriately stored or shipped. When unfolded, however, mat 10 will return to its normal flat, planar configuration.

Mat 10 may also be formed by extruding components panels 16 and 17 and bridge 18, in a conventional manner, then passing the hot extrudate over a strip, or a tape, in the configuration of hinge 20, and feeding the composite material into a conventional calendering apparatus. Upon leaving the rollers of the calendering apparatus, the composite plastic sheet may be cut into predetermined lengths and appropriately shaped by conventional means. As in the previous description, the resultant mat 10 may be folded and appropriately stored or shipped.

The following examples demonstrate the practice of the present invention. It is to be understood that these examples are utilized merely for illustrative purposes and are not to be considered as limitations of the present invention.

EXAMPLE 1

A thermoplastic polyurethane tape having a cycloid configuration and being 0.100 inches thick by 2.00 inches wide was fed into the extrusion take-off rolls downstream of the die lip on the upper surface of a PVC mat extrudate for a 0.145 inch mat. The rolls were maintained at 150° F. The resultant plastic sheet was then permitted to be cooled to room temperature, and then was cut at a predetermined length in the configuration of a chair mat. Mats so prepared have been rotary fatigue tested at 8 rpm with two foam underlay pads. Such testing demonstrated that failure, that is, stress cracking, eventually occurred outside of the hinge area demonstrating that there was no weakening of the product in view of the presence of the hinge.

EXAMPLE 2

The mat described in Example 1 was produced, using instead of the thermoplastic polyurethane tape, a plasticized polyvinylchloride tape having a Shore A durometer hardness of 75. Similar results to those described with respect to Example 1 were obtained.

From the foregoing, it is apparent that the objects of the present invention have been fully accomplished. As a result of this invention, the improved foldable plastic product in the configuration of a chair mat substantially avoids the problems associated with prior art chair mats.

Having thus described and exemplified the preferred embodiment of the present invention, it will be understood that such description and illustration is by way of example only and that such modifications and changes as may suggest themselves to those skilled in the art are intended to fall within the scope of the present invention, as limited only by the appended claims.

We claim:

1. A foldable plastic product comprising:

a sheet of material including at least two panels having a planar upper surface, a lower surface and sides spanning said upper and lower surfaces defining the thickness of said sheet;

at least one bridge portion having an uninterrupted planar upper surface and a lower surface, said upper surface integrally connecting the upper surfaces of said panels and being coplanar therewith, the thickness of said bridge portion being less than the thickness of said panels;

at least one hinge portion of a cycloidal configuration and having an upper surface coincident with the lower surface of said bridge portion and an uninterrupted lower surface integrally connecting the lower surface of said panels and being coplanar therewith, said hinge portion being formed of a material selected from the group consisting of thermoplastic polyurethanes, thermoplastic polyesters, natural and synthetic rubbers and plasticized polyvinylchlorides having a Shore A hardness of about 55 to about 85 durometer.

2. A foldable plastic product, as set forth in claim 1, wherein said hinge portion is of a thermoplastic polyurethane having a Shore A hardness of about 70 durometer to about 75 durometer.

3. A foldable plastic product, as set forth in claim 2, wherein said panels and said bridge portion are of a polyvinylchloride having a Shore D hardness of about 55 to about 75 durometer.

4. A foldable plastic product, as set forth in claim 3, wherein said hinge portion is of a thermoplastic polyurethane having a Shore A hardness of about 70 durometer to about 75 durometer.

5. A foldable plastic product, as set forth in claim 3, wherein said hinge portion is of a plasticized polyvinylchloride having a Shore A hardness of between about 70 and 75 durometer.

6. A foldable plastic product, as set forth in claim 1, wherein said hinge portion is of a plasticized polyvinylchloride having a Shore A hardness of between about 70 and about 75 durometer.

7. A foldable plastic product, as set forth in claim 1, wherein said bridge portion has a thickness of between about one-third and about two-thirds the thickness of said sheet.

8. A foldable plastic product comprising:

a sheet of material including at least two panels having a planar upper surface, a lower surface and sides spanning said upper and lower surfaces defining the thickness of said sheet;

at least one bridge portion having an uninterrupted planar upper surface and a lower surface, said upper surface integrally connecting the upper surfaces of said panels and being coplanar therewith, the thickness of said bridge portion being less than the thickness of said panels;

at least one hinge portion of a trapezoidal configuration and having an upper surface coincident with the lower surface of said bridge portion and an uninterrupted lower surface integrally connecting the lower surface of said panels and being coplanar therewith, said hinge portion being formed of a material selected from the group consisting of thermoplastic polyurethanes, thermoplastic polyesters, natural and synthetic rubbers and plasticized polyvinylchlorides having a Shore A hardness of about 55 to about 85 durometer.

9. A foldable plastic product, as set forth in claim 8, wherein said hinge portion is of a thermoplastic polyurethane having a Shore A hardness of about 70 durometer to about 75 durometer.

10. A foldable plastic product, as set forth in claim 9, wherein said panels and said bridge portion are of a polyvinylchloride having a Shore D hardness of about 55 to about 75 durometer.

11. A foldable plastic product, as set forth in claim 10, wherein said hinge portion is of a thermoplastic polyurethane having a Shore A hardness of about 70 durometer to about 75 durometer.

12. A foldable plastic product, as set forth in claim 10, wherein said hinge portion is of a plasticized polyvinylchloride having a Shore A hardness of between about 70 and 75 durometer.

13. A foldable plastic product, as set forth in claim 8, wherein said hinge portion is of a plasticized polyvinylchloride having a Shore A hardness of between about 70 and about 75 durometer.

14. A foldable plastic product, as set forth in claim 8, wherein said bridge portion has a thickness of between about one-third and about two-thirds the thickness of said sheet.

* * * * *